US009525932B2

(12) United States Patent
Litovsky et al.

(10) Patent No.: US 9,525,932 B2
(45) Date of Patent: Dec. 20, 2016

(54) ACOUSTIC DEVICE HAVING ACTIVE DRIVERS MOUNTED TO A PASSIVE RADIATOR DIAPHRAGM

(71) Applicant: Bose Corporation, Framingham, MA (US)

(72) Inventors: Roman Litovsky, Newton, MA (US); Chester Smith Williams, Lexington, MA (US)

(73) Assignee: BOSE CORPORATION, Framingham, MA (US)

( * ) Notice: Subject to any disclaimer, the term of this patent is extended or adjusted under 35 U.S.C. 154(b) by 53 days.

(21) Appl. No.: 14/605,059

(22) Filed: Jan. 26, 2015

(65) Prior Publication Data

US 2016/0219362 A1 Jul. 28, 2016

(51) Int. Cl.

| | |
|---|---|
| ***H04R 1/28*** | (2006.01) |
| ***H04R 1/26*** | (2006.01) |
| *H04R 9/06* | (2006.01) |
| *H04R 1/22* | (2006.01) |

(52) U.S. Cl.

CPC ..... *H04R 1/2834* (2013.01); *H04R 1/26* (2013.01); *H04R 1/227* (2013.01); *H04R 9/063* (2013.01); *H04R 9/066* (2013.01)

(58) Field of Classification Search

CPC ..... H04R 1/283; H04R 1/2834; H04R 1/227; H04R 1/2807; H04R 1/2811; H04R 9/063; H04R 9/066; H04R 5/02; H04R 1/26

See application file for complete search history.

(56) References Cited

U.S. PATENT DOCUMENTS

| | | | | |
|---|---|---|---|---|
| 3,666,041 A * | 5/1972 | Engelhardt | H04R 1/30 | 181/145 |
| 4,207,963 A * | 6/1980 | Klasco | H04R 1/26 | 16/110.1 |
| 4,379,951 A * | 4/1983 | Gabr | H04N 5/642 | 181/161 |
| 4,903,300 A * | 2/1990 | Polk | H04R 1/2842 | 181/150 |
| 4,924,963 A * | 5/1990 | Polk | H04R 1/2842 | 181/141 |
| 5,216,210 A * | 6/1993 | Kammer | H04R 1/2834 | 181/144 |
| 5,657,392 A * | 8/1997 | Bouchard | H04R 1/02 | 181/145 |

(Continued)

FOREIGN PATENT DOCUMENTS

WO 2009120467 A1 10/2009

OTHER PUBLICATIONS

U.S. Appl. No. 98/594,358, filed Nov. 26, 2013, Litovsky, et al.

(Continued)

*Primary Examiner* — Curtis Kuntz
*Assistant Examiner* — Joshua Kaufman
(74) *Attorney, Agent, or Firm* — Schmeiser, Olsen & Watts LLP

(57) ABSTRACT

A balanced acoustic device includes an enclosure defining an acoustic chamber, a first passive radiator diaphragm having an active driver assembly and a second passive radiator diaphragm having a plurality of active driver assemblies that are laterally offset. The moving mass of the first passive radiator assembly is substantially equal to the moving mass of the second passive radiator assembly.

19 Claims, 8 Drawing Sheets

(56) References Cited

U.S. PATENT DOCUMENTS 5,809,154 A * 9/1998 Polk ..... H04R 1/2826 181/156
5,850,460 A * 12/1998 Tanaka ..... H04R 1/2873 381/182
6,031,919 A * 2/2000 Funahashi ..... H04R 1/2842 181/145
6,169,811 B1 * 1/2001 Croft, III ..... H04R 1/2842 181/144
7,113,607 B1 * 9/2006 Mullins ..... H03G 11/002 381/103
7,133,533 B2 * 11/2006 Chick ..... H04R 1/2834 381/160
8,031,896 B2 10/2011 Chick et al.
8,189,841 B2 * 5/2012 Litovsky ..... H04R 1/2834 381/182
8,638,975 B2 * 1/2014 Jeffery ..... H04R 1/025 381/386
8,837,763 B1 * 9/2014 Millen ..... H04R 1/2834 181/145
9,369,817 B2 * 6/2016 North ..... H04S 5/00
2001/0024508 A1 * 9/2001 Croft, III ..... H04R 1/2842 381/345
2001/0031061 A1 * 10/2001 Coombs ..... H04R 1/2826 381/349
2005/0018868 A1 * 1/2005 Chick ..... H04R 1/2834 381/349
2005/0157900 A1 * 7/2005 Litovsky ..... H04R 7/20 381/349
2007/0000720 A1 * 1/2007 Noro ..... H04R 1/2834 181/156
2007/0081687 A1 * 4/2007 Hayashi ..... H04R 1/2834 381/345
2007/0092096 A1 * 4/2007 Litovsky ..... H04R 1/2834 381/349
2007/0201712 A1 * 8/2007 Saiki ..... H04R 1/2834 381/186
2007/0291965 A1 * 12/2007 Noro ..... H04R 1/2834 381/182
2008/0292117 A1 * 11/2008 Guenther ..... H04R 1/2834 381/150
2009/0245561 A1 * 10/2009 Litovsky ..... H04R 1/2834 381/345
2010/0027815 A1 * 2/2010 Burge ..... H04R 1/2834 381/182
2010/0111343 A1 * 5/2010 Hsu ..... H04R 1/2834 381/335
2011/0284315 A1 * 11/2011 Litovsky ..... H04R 1/02 181/156
2013/0195311 A1 * 8/2013 Sahyoun ..... H04R 1/2834 381/395
2013/0213628 A1 * 8/2013 Litovsky ..... H04R 1/2834 165/185
2013/0213730 A1 * 8/2013 Litovsky ..... H04R 1/02 181/199
2014/0029782 A1 * 1/2014 Rayner ..... H04R 1/2834 381/386
2014/0064522 A1 * 3/2014 Litovsky ..... H04R 3/00 381/152
2014/0193005 A1 * 7/2014 Riggs ..... H04R 5/02 381/300
2014/0334657 A1 * 11/2014 Guenther ..... H04R 5/0335 381/370
2014/0348350 A1 * 11/2014 Barrentine ..... H04R 1/2834 381/166
2014/0348351 A1 * 11/2014 Barrentine ..... H04R 1/42 381/166
2014/0355806 A1 * 12/2014 Graff ..... H04R 1/025 381/334
2015/0195629 A1 * 7/2015 Sumitani ..... H04R 7/04 381/191
2015/0281844 A1 * 10/2015 Stabile ..... H04R 1/2834 381/345
2016/0094909 A1 * 3/2016 Johnston ..... H04R 9/063 381/186

OTHER PUBLICATIONS

International Search Report & Written Opinion in counterpart International Patent Application No. PCT/US16/14660, mailed on Apr. 29, 2016; 12 pages.

* cited by examiner

ACOUSTIC DEVICE HAVING ACTIVE DRIVERS MOUNTED TO A PASSIVE RADIATOR DIAPHRAGM

BACKGROUND

This disclosure relates to acoustic radiating devices that include both active drivers and passive radiators, in which positions and characteristics of the active drivers and passive radiators are selected to reduce unwanted vibrations coupled into acoustic structures and to reduce device size.

SUMMARY

In one aspect, an acoustic device includes a first passive radiator diaphragm disposed in an opening of a first wall of the acoustic enclosure and is configured to move parallel to a first axis that extends through a center of mass of the first passive radiator diaphragm and orthogonal to the first wall in response to a pressure change in the acoustic chamber. The acoustic device also includes a second passive radiator diaphragm disposed in an opening of a second wall of the acoustic enclosure and is configured to move parallel to a second axis that extends through a center of mass of the second passive radiator diaphragm and orthogonal to the second wall in responsive to a pressure change within the acoustic chamber. The acoustic device further includes a first active driver assembly disposed in an opening in the first passive radiator diaphragm and a plurality of second active drivers assemblies each disposed in an opening in the second passive radiator diaphragm. Each of the second active driver assemblies is laterally offset from the second axis. A moving mass of the first passive radiator assembly is substantially equal to a moving mass of the second passive radiator assembly.

Embodiments may include one of the following features, or any combination thereof. The lateral offsets of the second active driver assemblies can be selected to avoid an interference with the first active driver assembly. The first and second axes may be parallel or colinear. The acoustic device may further include a compliant coupling mechanism that couples the first active driver assembly to the second passive radiator diaphragm or to at least one of the walls of the acoustic enclosure. The first and second walls may be parallel to each other. The mass of the first active driver assembly may be substantially equal to a sum of the masses of the second active driver assemblies and the mass of the first active radiator diaphragm may be the same as the mass of the second active radiator diaphragm.

In another aspect, an acoustic device includes an acoustic enclosure having walls defining an acoustic chamber, a first passive radiator diaphragm disposed in an opening of a first wall of the acoustic enclosure and configured to move parallel to a first axis that extends through a geometrical center of the first passive radiator diaphragm and orthogonal to the first wall in response to a pressure change in the acoustic chamber, and a second passive radiator diaphragm disposed in an opening of a second wall of the acoustic enclosure and configured to move parallel to a second axis that extends through a geometrical center of the second passive radiator diaphragm and orthogonal to the second wall in responsive to a pressure change within the acoustic chamber. The first and second walls of the acoustic enclosure are parallel to each other. The acoustic device further includes a first active driver assembly disposed in an opening in the first passive radiator diaphragm and having a geometrical center on the first axis, and a plurality of second active drivers assemblies each disposed in an opening in the second passive radiator diaphragm. Each of the second active driver assemblies has a geometrical center that is laterally offset from the second axis. A sum of the moving mass of the first passive radiator diaphragm and the mass of the first active driver assembly is substantially equal to a sum of the moving mass of the second passive radiator diaphragm with the masses of the second active driver assemblies.

Embodiments may include one of the above and/or below features, or any combination thereof. The lateral offset of each of the second active driver assemblies may be equal to the lateral offset of each of the other second active driver assemblies. The acoustic device may further include a compliant coupling mechanism that couples the first active driver assembly to the second passive radiator diaphragm or to at least one of the walls of the acoustic enclosure.

In another aspect, an acoustic device includes an acoustic enclosure having walls defining an acoustic chamber, a first passive radiator diaphragm disposed in an opening of a first wall of the acoustic enclosure and configured to move parallel to a first axis that extends through a center of mass of the first passive radiator diaphragm and orthogonal to the first wall in response to a pressure change in the acoustic chamber, and a second passive radiator diaphragm disposed in an opening of a second wall of the acoustic enclosure and configured to move parallel to a second axis that extends through a center of mass of the second passive radiator diaphragm and orthogonal to the second wall in responsive to a pressure change within the acoustic chamber. The acoustic device further includes a first active driver assembly secured to a surface of the first passive radiator diaphragm and configured to radiate acoustic energy in a direction parallel to the first axis and through an opening in the second passive radiator diaphragm, and a plurality of second active drivers assemblies each disposed in an opening in the second passive radiator diaphragm. Each of the second active driver assemblies is laterally offset from the second axis and configured to radiate acoustic energy in a direction substantially parallel to the first axis. The moving mass of the first passive radiator assembly is substantially equal to the moving mass of the second passive radiator assembly.

Embodiments may include one of the above and/or below features, or any combination thereof. The acoustic device may further include a compliant coupling mechanism that couples the first active driver assembly to the second passive radiator diaphragm at the opening in the second passive radiator diaphragm through which the acoustic energy from the first active driver assembly radiates.

The above and further features and advantages may be better understood by referring to the following description in conjunction with the accompanying drawings, in which like numerals indicate like structural elements and features. The drawings are not necessarily to scale and are instead primarily intended to illustrate principles of features and implementations.

DETAILED DESCRIPTION

Figure 1A:
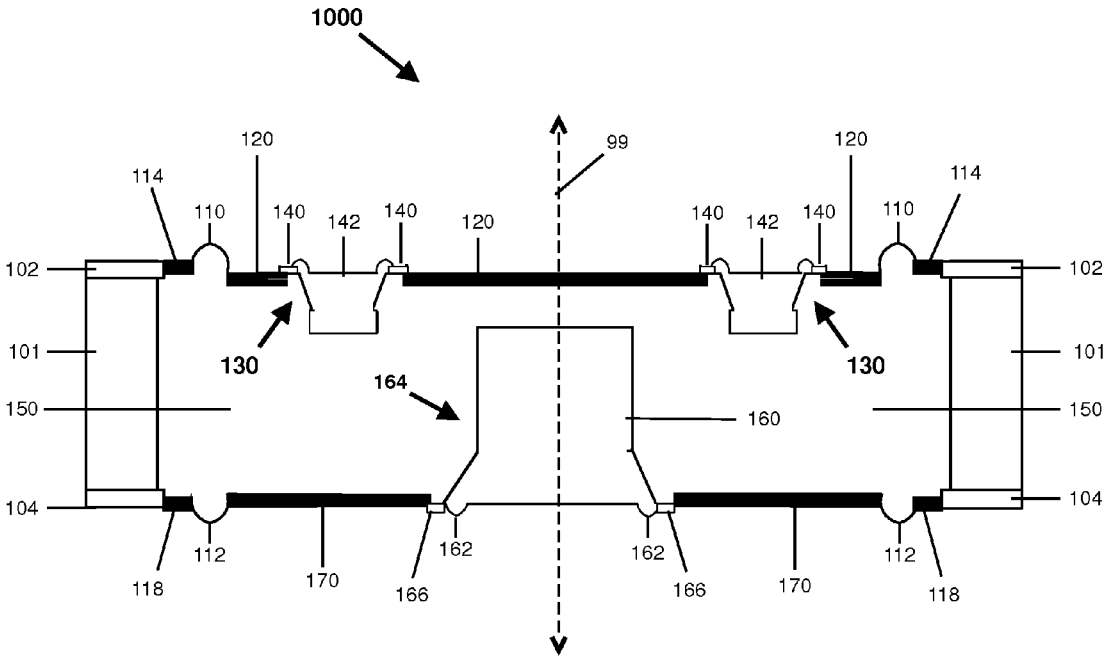
FIGS. 1A-1C are views of an example of an acoustic device that includes active drivers secured to passive radiator diaphragms.

An acoustic device, such as a loudspeaker system, may include one or more passive-radiator transducers. Unlike an active loudspeaker transducer, which may include a sound-producing diaphragm that moves in response to receipt of an electrical signal by the active transducer, a passive radiator is a non-electrical device that includes a sound-producing diaphragm mounted to an enclosure such that the diaphragm moves in response to variations in the air pressure of an acoustic volume defined by the enclosure. In one class of implementations, an enclosure having a passive radiator also includes an active driver that indirectly moves the passive radiator by producing air-pressure variations in the acoustic volume. In this way, a single electrical signal may drive an active driver and indirectly drive a passive radiator.

It is known that two or more passive radiator assemblies may be mounted to walls of an enclosure, such that the diaphragms of the passive radiator assemblies provide a greater effective radiating area than would a single radiator diaphragm. In such a design, all passive radiator diaphragms may be moved by air pressure variations produced by the active drivers. Herein, the term "effective radiating area" of an audio transducer is used to identify a total surface area of the transducer (or of a diaphragm of the transducer) that moves air in order to produce a sound wave.

A frequency response, efficiency, mechanical resonance, or other characteristic of a passive radiator may be a function of a moving mass of the passive radiator. In general, increasing a moving mass of a diaphragm of a passive-radiator assembly will modify the passive radiator's frequency response. This can be advantageous when increased low-frequency output is a design goal.

In certain cases, it may be desirable to limit the size or weight of a loudspeaker system that contains one or more passive radiator assemblies and active drivers. Although adding mass to one or more of the passive-radiator diaphragms may improve a performance characteristic of the loudspeaker, doing so may add an undesirable weight to the loudspeaker system.

One way to address this issue is to couple an active driver to a passive radiator diaphragm at a hole, or opening, in the diaphragm. Such a coupling results in a passively driven moving mass that is equal to the combined moving mass of the passive radiator diaphragm and the mass of the active driver. Coupling the active driver to the passive radiator diaphragm allows the moving mass of the passive radiator to be increased without incurring an addition of unnecessary weight to the loudspeaker.

In one example, a speaker system designed to produce low-frequency output might employ this technique by sealing a "woofer" active driver assembly at a hole formed in a passive radiator diaphragm. The woofer creates variations in air pressure within the speaker enclosure that produce motion of the passive-radiator diaphragm. In such implementations, the passive radiator assembly has a total moving mass equal to the sum of the moving mass of the passive radiator diaphragm and the mass of the active driver assembly. Sound output is produced by the motion of the passive radiator diaphragm and the motion of the active driver diaphragm resulting from application of the electrical signal to the active driver.

Although such a technique may reduce the overall weight of such a loudspeaker system, it may not resolve other issues inherent in a loudspeaker that incorporates one or more passive radiators. For example, the motion of a passive radiator diaphragm applies a reaction force to the loudspeaker enclosure. At frequencies at or near a resonance frequency of the passive-radiator assembly, these reaction forces may be relatively large and may cause unwanted vibrations of the enclosure.

This application incorporates by reference the disclosures of application Ser. No. 12/056,872, filed Mar. 27, 2008, now issued as U.S. Pat. No. 8,189,841; application Ser. No. 10/623,996, filed Jul. 21, 2003, now issued as U.S. Pat. No. 7,133,533; and application Ser. No. 13/600,967, filed Aug. 31, 2013. These disclosures are directed, in part, to the mounting of an active driver to a passive radiator diaphragm and to the mounting of passive radiators so that the passive radiators are acoustically in phase and vibrate mechanically out of phase to thereby reduce unwanted vibrations of the enclosure.

In a loudspeaker that includes two passive radiators, it is possible to mount the passive radiator assemblies in opposing walls of the enclosure such that the diaphragms respond to variations in pressure of an acoustic volume enclosed by the enclosure with motions that are acoustically in phase but mechanically out of phase. If the two passive radiators have dissimilar physical properties, the passive radiators may not respond in an identical way to a same pressure variation. This may result in each passive radiator assembly exerting a different reaction force on the enclosure. These uneven forces may create undesirable vibrations in the enclosure. Such passive radiators are described herein as being "unbalanced."

This undesirable effect may be reduced or avoided by balancing the passive radiator assemblies such that the two assemblies have equivalent physical characteristics. By way of examples, a physical characteristic of an assembly can include moving mass, effective radiating area, total suspension compliance, or combinations thereof.

In the loudspeaker described above, where an active driver is coupled to one passive radiator diaphragm, balancing may be performed by coupling an active driver having similar physical characteristics to the other passive radiator diaphragm. In particular, if the two passive radiators have similar moving masses and radiating areas, and the two active drivers have similar physical masses, the two active-driver/passive-radiator combinations will have similar moving masses and thus be properly balanced. Other balancing of active drivers may also be desirable, such as providing equal moving masses, compliances, diaphragm radiating areas, motor force, and damping.

The described arrangement may require a large acoustic enclosure. Typical active drivers include a motor which has a certain depth related to the motor force generated and the required excursion of a diaphragm that is coupled to the motor. In most implementations, the motor extends behind the diaphragm and into the acoustic chamber. In some examples where two passive radiators are mounted on opposite sides of an enclosure and each passive radiator diaphragm has an active driver attached, the motor structures of the active driver assemblies that protrude into the enclosure may interfere with each other. This may be problematic in a loudspeaker using a small enclosure where the passive radiator diaphragm radiating area is a large proportion of the surface area of the enclosure wall in which it is mounted (for example, greater than 40% of the area). Because an active driver assembly generally protrudes into an internal cavity of the enclosure, a small enclosure may not provide clearance sufficient for two active driver assemblies to be mounted on opposite walls of the enclosure such that their motor structures can be positioned back-to-back within the enclosure without interference.

Some of the acoustic devices disclosed herein address this problem by replacing at least one of the active driver assemblies with two or more smaller active driver assemblies, such that the smaller active driver assemblies in aggregate have similar physical characteristics and exhibit a similar acoustical performance as the single larger active driver assembly. This means that the two or more smaller active driver assemblies coupled to one passive radiator diaphragm have a similar total moving mass, effective radiating area, total suspension compliance, motor force, or an equivalent combination thereof, as the single larger active driver assembly coupled to the other passive radiator diaphragm. Because the smaller active driver assemblies protrude less into the interior of the enclosure, replacing a single larger active driver assembly into two or more smaller active driver assemblies that together have a moving mass similar to that of the larger active driver assembly may be sufficient to satisfy space constraints of a small enclosure. Additional benefit may be obtained by positioning the smaller active driver assemblies at locations that are laterally offset from the center of the diaphragm so as not to interfere with the larger active driver assembly in the opposite wall of the enclosure. A lateral offset, as used herein, means a perpendicular separation from an axis that extends through the center of mass of the diaphragm and typically through the geometrical center of the diaphragm.

FIGS. 1 through 5 illustrate examples of acoustic devices that incorporate features described above. All of these examples increase the moving masses of passive radiator assemblies by coupling one or more active driver assemblies to the passive radiator diaphragms. Aggregate characteristics of active driver assemblies for each diaphragm are chosen to balance the two coupled passive/active assemblies, and the active driver assemblies are laterally positioned relative to an axis of the passive radiator diaphragms to reduce a size of the acoustic device.

Figure 1B:
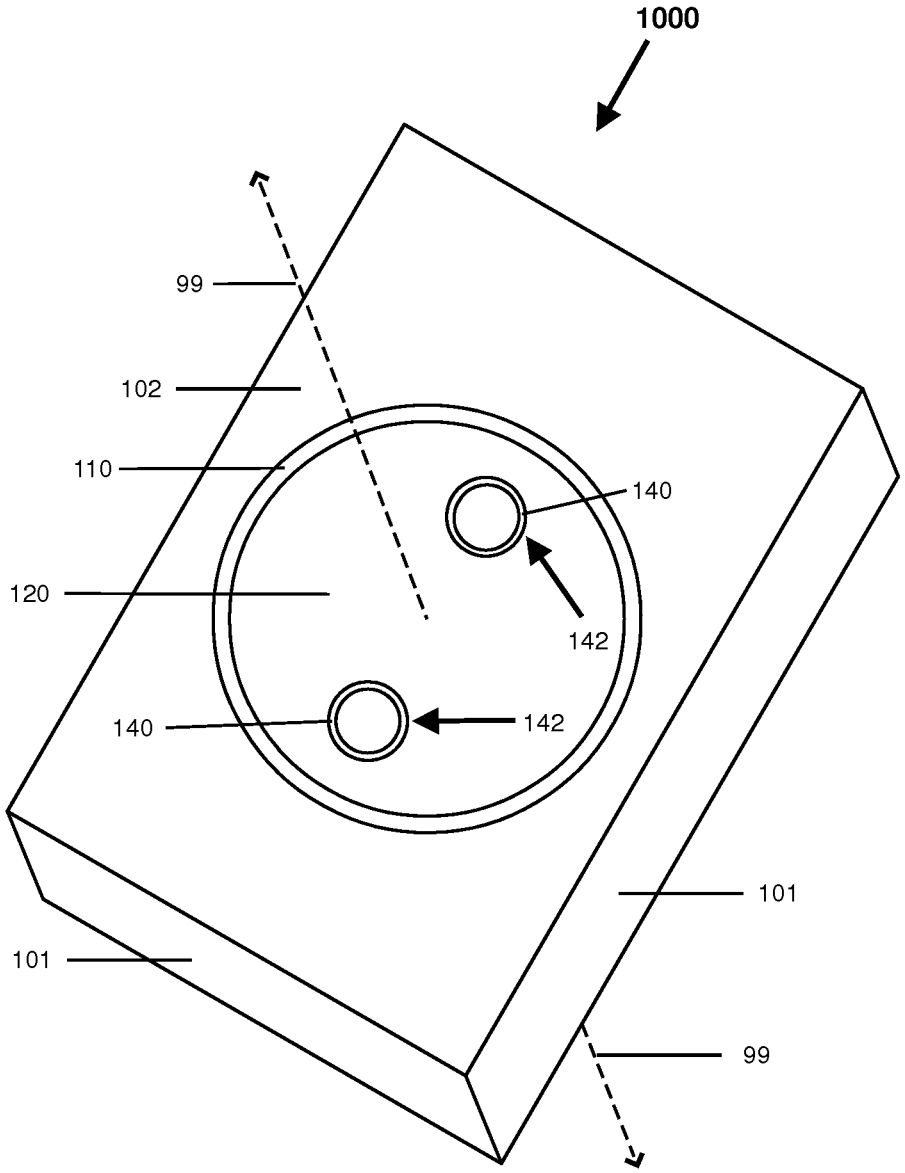
Figure 1C:
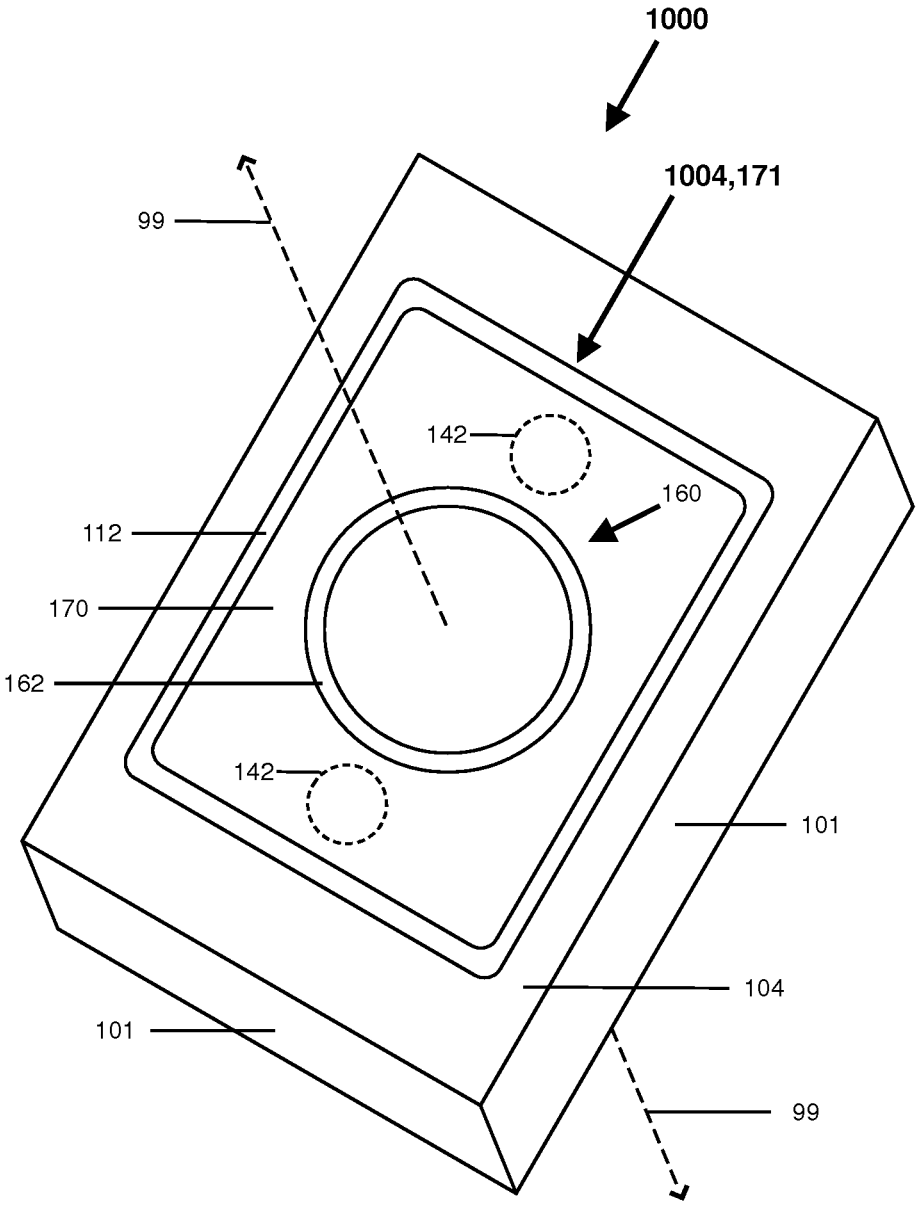

FIG. 1A is a cross-sectional view of one example of an acoustic device 1000. FIG. 1B and FIG. 1C are isometric top and bottom views, respectively, of the acoustic device 1000. Acoustic device 1000 provides an enclosed acoustic space, or chamber, 150 having an acoustic volume. Chamber 150 is defined by a substantially airtight enclosure having four side walls 101, top wall 102 and bottom wall 104. In some alternative configurations, acoustic chamber 150 is airtight except for a small air leak that adjusts air pressure within acoustic chamber 150 as a function of fluctuations in barometric pressure.

The top wall 102 includes a hole to accommodate a passive radiator assembly that includes a diaphragm 120. The perimeter of diaphragm 120 is mechanically coupled to the top wall 102 by a flexible surround 110 which in turn is coupled to a frame 114 which is secured to the top wall 102. The frame 114 is a rigid structure to which other components may also be mounted. The surround 110 allows the diaphragm 120 to move axially (vertically in the figure). In the example of FIG. 1A, axial motion of the passive-radiator diaphragm 120 is substantially parallel with an axis 99, that passes through the center of mass and geometrical center of diaphragm 120, and is normal to the plane of the top wall 102. Diaphragm 120 is shown as a planar structure in FIG. 1A; however, diaphragm 120 is a surface that moves in response to variations in air pressure within acoustic chamber 150, and may assume any shape known to those skilled in the art, such as a cone, a surface with a hyperbolic cross-section or other known curved cross section, or may have a flat circular, rectangular, or oval surface.

Diaphragm 120 has two holes or openings. An active driver assembly 130 having an active driver 142 is positioned in each hole and is coupled by a frame 140 of the active driver assembly 130 to the diaphragm 120 by a mechanism (not shown). The frame 140 may be part of a basket (not shown) that includes other structure, such as spiders, to which other components of the active driver 142 may be attached. The coupling mechanism may include a gasket, an adhesive bead, or another mechanism that creates a substantially airtight and substantially rigid seal between frame 140 and diaphragm 120. Each active driver 142 is an audio transducer that produces sound waves in response to a received electrical signal, and is distinguishable from each passive radiator which produces sound waves in response to variations in acoustic pressure within acoustic chamber 150.

The bottom wall 104 similarly has a hole in which a passive radiator assembly is mounted. The passive radiator assembly includes a diaphragm 170 that is mechanically coupled to a flexible surround 112 which in turn is coupled to a frame 118 that is secured to the bottom wall 104. Surround 112 allows diaphragm 170 to move axially and substantially parallel to axis 99. Diaphragm 170 may be any surface that may move axially in response to variations in air pressure within acoustic chamber 150, and may assume any shape known to those skilled in the art, such as a cone, a surface with a hyperbolic cross-section or other known curved cross section, or a flat circular, rectangular, or oval surface.

The diaphragm 170 has a hole or opening in which a woofer or other active driver assembly 164 is disposed. The frame 166 of the active driver assembly 164 is rigidly secured to the diaphragm 170 and a sealing or coupling mechanism (not shown) may be disposed between the diaphragm 170 and the frame 166. The sealing or coupling mechanism can include a gasket, an adhesive bead, or another mechanism that creates a substantially airtight seal between the frame 166 of the active driver assembly 164 and the diaphragm 170.

Active drivers 142 may create variations in air pressure within acoustic chamber 150 that move the diaphragm 120 and the diaphragm 170 in response to a first electrical audio signal applied to the active drivers 142. Similarly, active driver 160 may create variations in air pressure within acoustic chamber 150 that move the diaphragm 120 and the diaphragm 170 in response to a second electrical audio signal applied to the active driver 160.

In the example shown in FIG. 1A, each active driver 142 is smaller than active driver 160 and, in some implementations, may produce output throughout a higher frequency range than that of active driver 160. In one configuration, the larger active driver 160 and the two smaller active drivers 142 receive substantially identical electrical audio signals. In this example, the two smaller active drivers 142 provide essentially a same function as a single active driver.

In a second mode, the larger active driver 160 and the two smaller active drivers 142 receive substantially identical electrical audio signals at lower frequencies, but at higher frequencies, the two smaller active drivers 142 receive one or more electrical audio signals distinct from an electrical audio signal received by the larger active driver 160, and the signal received by the larger active driver 160 is rolled off at higher frequencies.

When an acoustic device comprises multiple passive-radiator diaphragms, failure to balance the moving masses of the passive radiators may result in vibrations that produce undesired artifacts, such as buzzing, rocking motions, and/or "walking" of the acoustic device when it sits on a surface while producing sound. Balancing may be performed by adjusting a mass of each radiator or by adjusting a distribution of mass of each radiator, as will be described in more detail.

Examples and implementations described herein accomplish balancing by mounting multiple active driver assemblies 130 in the diaphragm of the passive radiator 120 such that a mechanical characteristic of the combination of diaphragm 120 and active driver assemblies 130 is balanced with an analogous mechanical characteristic of the diaphragm 170 and active driver assembly 164.

The mechanical characteristic may comprise a total moving mass, an effective mass, a distribution of mass, a mechanical resonance, a compliance of a sealing or coupling mechanism, or combinations thereof. The balancing may be performed by selecting a mass of each active driver assembly 130, a lateral position of each driver assembly 130 relative to the axis 99 of the diaphragm 120, or a compliance of a surround.

A resonant frequency of a passive radiator moving mass with the compliance of the volume of air with which it interacts is a function of the passive-radiator diaphragm area as well as the acoustic volume and the moving mass of the passive radiator. A larger area passive-radiator tuned to the same resonance frequency as a smaller area passive radiator, for the case where each is coupled to a similar active driver and acoustic volume, has a greater moving mass than the smaller passive radiator.

Increasing a passive radiator's moving mass may be problematic if it is desirable to keep the total weight of an acoustic device less than a certain value or within a certain weight range, such as in a portable speaker system. There exists a trade-off between the beneficial effects of increasing the passive-radiator diaphragm radiating area and the drawback of requiring increased moving mass for maintaining the same resonance frequency.

In the illustrated example, active driver assemblies 130 are coupled to passive-radiator diaphragm 120. Coupling active driver assemblies 130 to passive-radiator diaphragm 120 adds the mass of the driver assemblies 130 to the total moving mass of diaphragm 120. Increasing the mass of diaphragm 120 with the masses of driver assemblies 130, which already contribute to the total weight of acoustic device 1000, reduces or eliminates the extra mass that must be added to diaphragm 120 in order to tune the passive radiator assembly to a particular low frequency.

When a passive radiator diaphragm vibrates, the moving mass produces a force. In a speaker system that includes only one passive radiator assembly, this force might be great enough at frequencies at or near a resonance frequency of the passive radiator assembly to induce undesirable vibrations in the enclosure. This undesirable effect may, however, can be reduced or eliminated by configuring such a system with a second passive radiator assembly that is in a balanced arrangement. The two assemblies are considered to be balanced if the two assemblies have similar inertia, such that the vibrations each induces to an enclosure tend to cancel each other. Similar inertia may exist when the two assemblies are configured such that their diaphragms have similar surface areas and that the assemblies have similar moving masses. Thus the acoustic device examples described herein comprise two passive radiator assemblies each having one or more active driver assemblies coupled to the passive radiator diaphragm wherein the passive radiator assemblies have a similar radiating surface area and a similar total moving mass.

As shown in FIG. 1A, the passive radiator assembly, including the two active driver assemblies 130, in top wall 102 may be balanced to the other passive radiator assembly, including active driver assembly 164, in bottom wall 104. Active driver assemblies 130 and 164 are selected such that, if an effective radiating area of passive-radiator diaphragm 120 is substantially the same as an effective radiating area of passive-radiator diaphragm 170, then a combined moving mass of the diaphragm 120 and active driver assemblies 130 in top wall 102 are similar to a combined moving mass of the diaphragm 170 and active driver assembly 164 in bottom wall 104. Such a configuration ensures that the two combined assemblies have similar inertia values and tend to cancel mechanical vibrations.

In one general case, if the moving masses and effective radiating areas of the two passive radiator assemblies are similar, then active driver assemblies 130 and active driver assembly 160 are selected such that a combined mass of active driver assemblies 130 is equal to a moving mass of the active driver assembly 164. If a close match is not possible, balancing may still be implemented by adding a small mass to one or more of the passive radiator diaphragms 120 or 170. More generally, it should be noted that the moving masses of the two passive radiator diaphragms 120 and 170 (without active driver assemblies) do not have to be equal and that the sum of the masses of the active driver assemblies in one passive radiator diaphragm do not need to equal the sum of the one or more active driver assemblies in the other passive radiator diaphragm. Rather, the masses of the passive radiator diaphragms may be different and the sums of the active driver assembly masses in each diaphragm may be different as long as the combination of the moving masses of a diaphragm and its active driver assemblies is balanced to the combination of the moving masses of the other diaphragm and its active driver assembly.

Passive radiator assemblies may be balanced even when active driver assemblies in a passive radiator diaphragm are not identical in mass. In such cases, a moment between a center of a passive radiator assembly and a center of mass of an active driver assembly secured to the diaphragm of the passive radiator assembly need to be balanced with the moments similarly defined for one or more other active driver assemblies secured to the same diaphragm. For two active driver assemblies coupled to the diaphragm, if one of the active driver assemblies is smaller and lighter than the other active driver assembly, that smaller and lighter assembly should be laterally positioned farther from the center of mass and geometrical center of the passive radiator diaphragm 120 than the other active driver assembly. When properly positioned in this manner, rocking is prevented.

In another example, active driver assemblies 130 comprise an active midrange driver and an active tweeter driver, both mounted to a same passive-radiator diaphragm. In yet another example, in which all active or passive assemblies reproduce lower frequency energy (i.e., energy that may excite the passive radiator assemblies at their tuning frequency), the acoustical outputs of the active drivers 142 are also balanced with the acoustical output of the active driver 164. In this example, the pair of active drivers 142 creates the same internal acoustic pressure as the single active woofer driver 160. In contrast, if the pair of active drivers 142 do not produce the same acoustic output as the single active driver 160, the two drivers 142 can be made to balance with the active driver 160 by altering an amplitude or other characteristic of one or more of the electrical audio signals supplied to one or more of the three active drivers 142 and 160.

In one example, proper balancing is achieved in a speaker system with identical passive radiator assemblies, each of which has a same radiating area and a same moving mass; and coupling similarly identical active drivers to each passive radiator assembly. In some applications, however, when a design or cost constraint bars such a configuration, the examples described herein allow proper balancing to be achieved when a system includes heterogeneous passive radiators or active drivers.

As shown in FIG. 1A, active driver assemblies 130 are laterally offset in position such that the active driver assemblies 130 do not physically interfere with the structure of active driver assembly 164. In implementations wherein the enclosure must be relatively thin (i.e., where a distance between diaphragm 120 and diaphragm 170 must be limited), it may be physically impossible to balance the passive-radiator assemblies by coupling each passive radiator assembly to a single centered active driver assembly.

Examples described herein address this problem by instead providing in the diaphragm 120 of one passive-radiator assembly multiple smaller active driver assemblies 130 so that the multiple active driver assemblies 130 in aggregate have a moving mass similar or equal to that of active driver assembly 164 and so that the smaller active driver assemblies 130 are offset from the axis 99. As a result, the extension of the structures of the smaller active driver assemblies 130 into the acoustic chamber 150 does not interfere with the extension of the structure of the larger active driver assembly 164 into the acoustic chamber 150.

In some implementations, such as the example shown in FIG. 1A, the lateral offset distance from the axis 99 may be selected as a function of relative masses of active driver assemblies 130, but when the smaller active driver assemblies 130 are characterized by substantially equal mass, the active driver assemblies 130 should be arranged symmetrically across the diaphragm 120 and equidistant from axis 99. These considerations also apply to the examples shown in the other figures.

Figure 2:
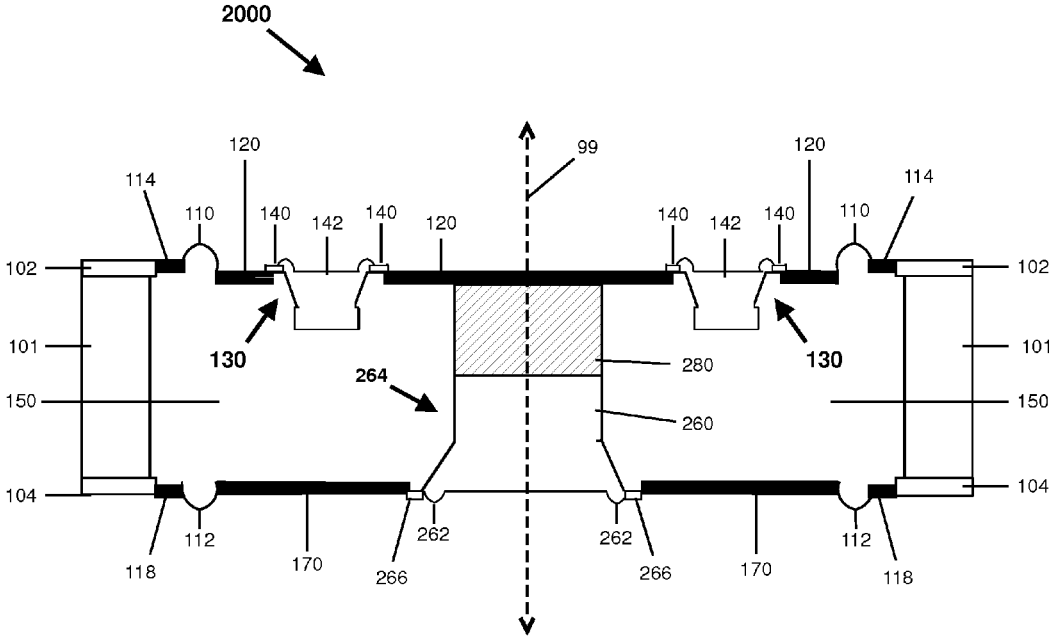
FIG. 2 is a cross-sectional view of another example of an acoustic device that includes active drivers secured to passive radiator diaphragms, in which the passive radiator diaphragms are compliantly coupled to each other.

FIG. 2 shows a cross-sectional view of a second example of an acoustic device 2000 in accordance with principles of the present design, where components of acoustic device 2000 share the same or substantially the same structural and functional aspects of analogous components of the acoustic device 1000 shown in FIG. 1A. In this example, the active driver, or woofer, 260 and other components of the active driver assembly 264 (including surround 262 and frame 266) may be of a different size and mass than the active driver 160 and active driver assembly 164 of FIG. 1A. Unlike FIG. 1, the active driver assembly 264 is mechanically coupled to diaphragm 120 disposed in the top wall 102 by a compliant coupling mechanism 280 that does not substantially constrain motion of diaphragm 120 parallel to axis 99, but substantially restricts motion along other axes, such as side-to-side motion or rocking motion. For example, the coupling mechanism may be a soft foam block. Such a compliant coupling mechanism 280 may provide advantages to operation of both passive radiators by reducing instabilities or rocking motions of the diaphragms 120 and 170. The compliant coupling mechanism 280 may further improve operation of the passive radiator assemblies by reducing unwanted artifacts that may result from a mechanical or acoustic resonance of a component of acoustic device 2000, or that may result from imperfect balancing. Such an imperfection may result, for example, from a mass imbalance, from an inability to utilize a flexible surround that eliminates rocking motion about a plane of a diaphragm 120 or 170, or from design constraints that prevent elimination of an enclosure resonance.

Compliant coupling mechanism 280 may also reduce a tendency of loudspeaker 2000 to vibrate or rock at frequencies near a resonance frequency of a passive radiator assembly, as loaded by other components of acoustic device 2000. This tendency may result from an inability to completely balance the two passive radiators assemblies.

Compliant coupling 280 may take any form known to those skilled in the art of speaker design to compliantly couple two moving masses or to compliantly couple one moving mass to a fixed mass. Such a form may include an adhesive, a spring, or another coupling mechanism that substantially constrains movement of diaphragm 120 to motion along axis 99.

Figure 3A:
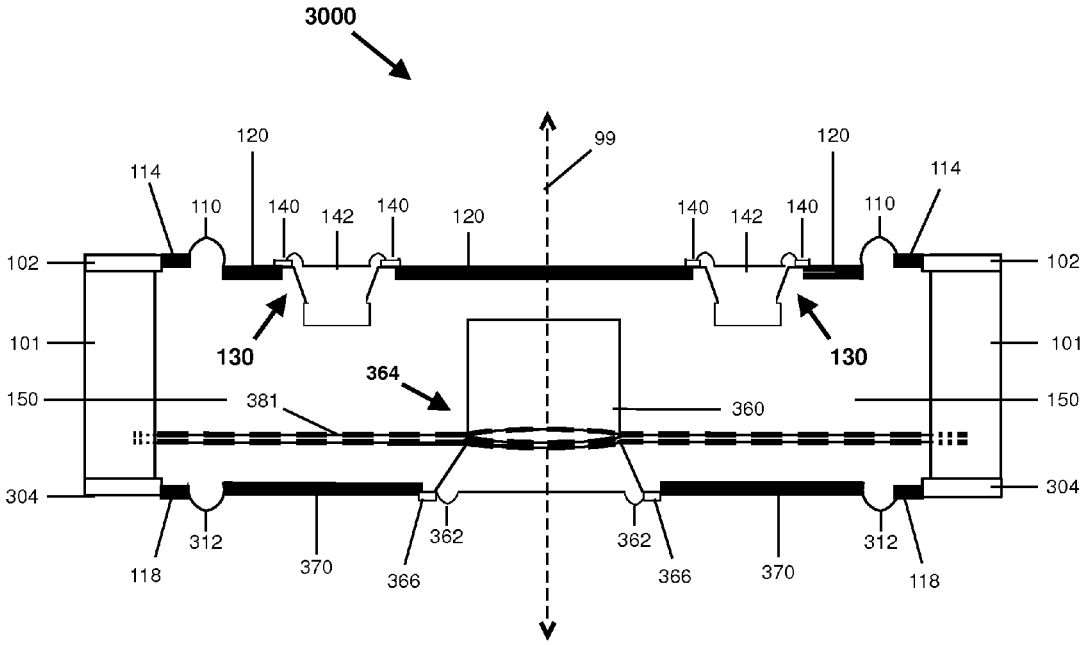
FIGS. 3A and 3B are views of another example of an acoustic device that includes active drivers secured to passive radiator diaphragms, in which a passive radiator assembly is compliantly coupled to walls of an acoustic enclosure.

FIG. 3A is a cross-sectional view of a third example of an acoustic device 3000 in accordance with principles of the present design, wherein components of acoustic device 3000 may share the same or substantially the same structural and functional aspects of analogous components of acoustic device 1000 of FIG. 1A.

A compliant coupling mechanism 381 couples active driver assembly 364 to two enclosure walls 101 such that the coupling does not substantially constrain motion of diaphragm 370 along axis 99, but substantially restricts motion of diaphragm 370 along other axes, such as a side-to-side motion or a rocking motion. Alternatively, the compliant coupling mechanism 381 can couple the active driver assembly 364 to non-moving portion of acoustic device 3000. Because the active driver assembly 364 has substantial mass relative to the total moving mass of the combined passive radiator assembly and active driver assembly 364, and because the center of mass of the active driver assembly 364 is generally displaced from the plane of the passive radiator surround element 312, the tendency of the acoustic device 3000 to rock in an undesirable fashion is increased. This rocking is similar to what would occur for the acoustic device 2000 of FIG. 2 if the compliant coupling mechanism 280 were absent.

By limiting undesired off-axis motion, a compliant coupling mechanism 381 may reduce undesirable vibrations or rocking motion that may result, for example, from an inability to balance the two passive radiator assemblies. In some implementations, undesirable vibration or motion may further result from an inability to use a flexible surround 110 that completely eliminates side-to-side motion parallel to a plane of the diaphragm 120, or from design constraints that result in an inability to eliminate an enclosure resonance or to eliminate a condition that produces uneven pressure on a diaphragm 120 or 370, such as turbulence within acoustic chamber 150.

The compliant coupling mechanism 381 may take any form known to those skilled in the art of speaker design that may compliantly couple one moving mass to a fixed mass. Such a form may include an adhesive, a spring, or another coupling mechanism that substantially constrains movement of diaphragm 120 to motion along axis 99. In the acoustic device of FIG. 3A, coupling mechanism 381 is shown as a compliant bracket that affixes the active driver assembly 364 to side walls 101 of the enclosure. In this example, coupling bracket 381 protrudes into the side walls 101.

Figure 3B:
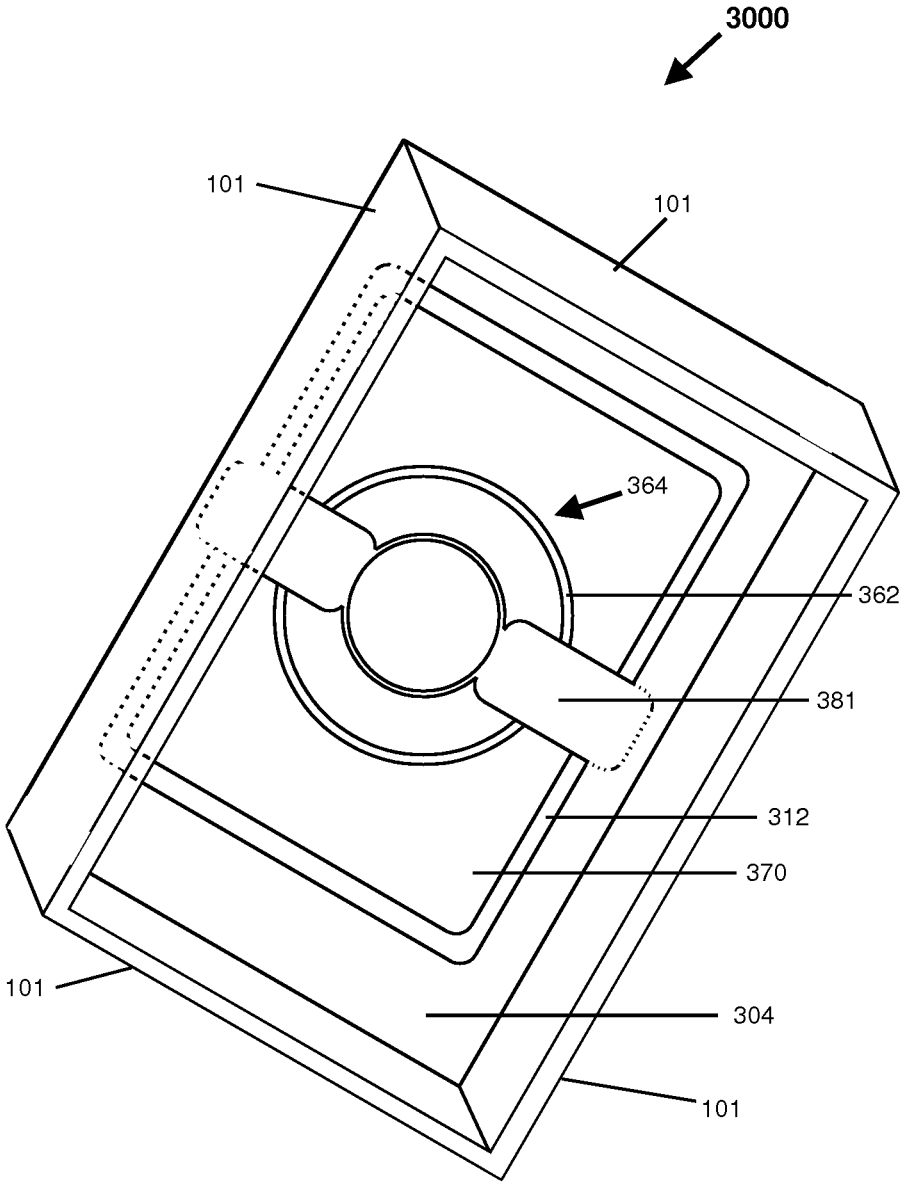

FIG. 3B is an isometric view of acoustic device 3000 of FIG. 3A that shows relative positioning of internal components of acoustic device 3000 as seen from a viewing position above acoustic device 3000. The top wall 102 and components mounted to the top wall 102 are not shown in order to reveal other elements of acoustic device 3000 including a rectangular diaphragm 370 and its surround 312. As illustrated, compliant coupling mechanism 381 includes an annular structure that attached to active driver assembly 364. In other examples, compliant coupling mechanisms may assume different shapes or may be attached to the active driver assembly 364 at different points or by means of one or more differently shaped attachment structures. For example, items such as screws, rivets, snap fits and adhesives can be used for attachment.

Figure 4:
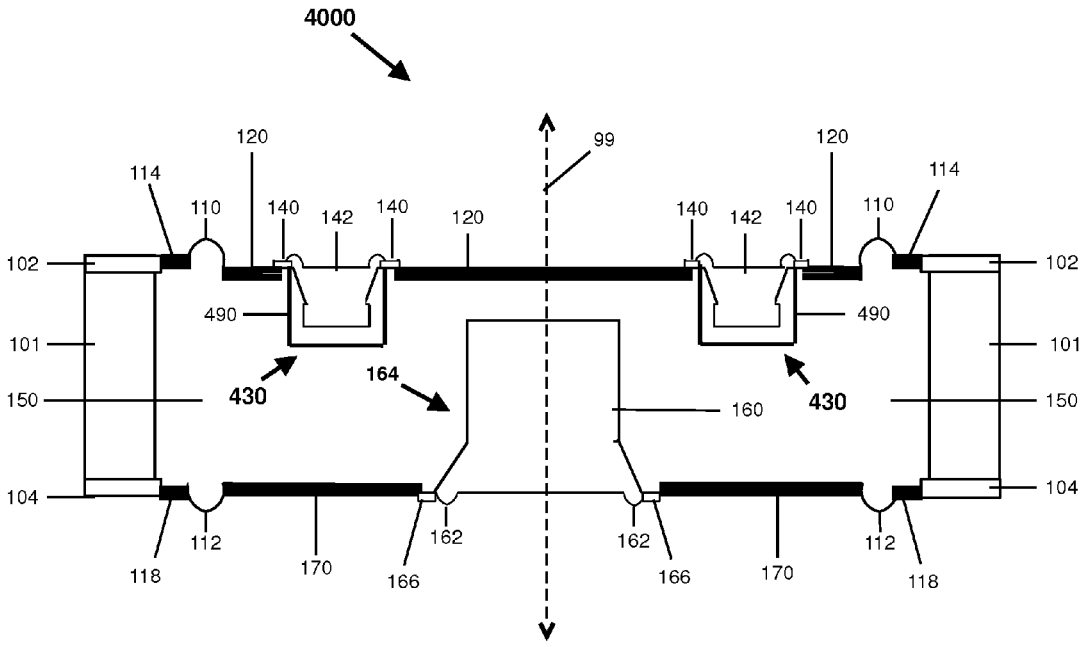
FIG. 4 is a cross-sectional view of another example of an acoustic device that includes active drivers secured to passive radiator diaphragms, in which some of the active drivers are acoustically isolated from the acoustic chamber.

FIG. 4 shows a cross-sectional view of a fourth example of an acoustic device 4000 in accordance with principles described above in which components of acoustic device 4000 may share the same or substantially the same structural and functional aspects of components of acoustic device 1000 of FIG. 1A.

Unlike earlier examples described above, each active driver assembly 430 includes a back enclosure 490 that acoustically isolates the active driver 142 from the volume of air in acoustic chamber 150. In one example, each active driver 142 is fitted into the top of cup-shaped back enclosure 490 and the active driver assembly 430 is sealed and rigidly coupled to the passive radiator diaphragm 120.

In this example, each enclosure 490 completely seals the rearward side of active driver 142 to acoustically isolate the active driver 142 from acoustic volume 150. Each active driver assembly 430 thus produces acoustic output into the exterior environment of acoustic device 4000, but does not contribute substantial pressure variations within acoustic volume 150 that would otherwise exert a significant force on passive radiator diaphragms 120 and 170.

In the illustrated example, the total moving mass of the active driver assemblies 430, including the mass of the back enclosures 490, contributes to the moving mass of the passive radiator diaphragm 120. As described above, undesirable vibrations and rocking of acoustic device 4000 may thus be reduced by proper selection of the mass and position of each active driver assembly 430 to achieve balancing of the two passive radiators.

Although FIG. 4 depicts a modification of the acoustic device 1000 of FIG. 1, it should be recognized that other examples of acoustic devices described above and shown in the other figures may be similarly modified so that each active driver assembly 130 includes a back enclosure for acoustic isolation from the air in the acoustic chamber 150.

Figure 5:
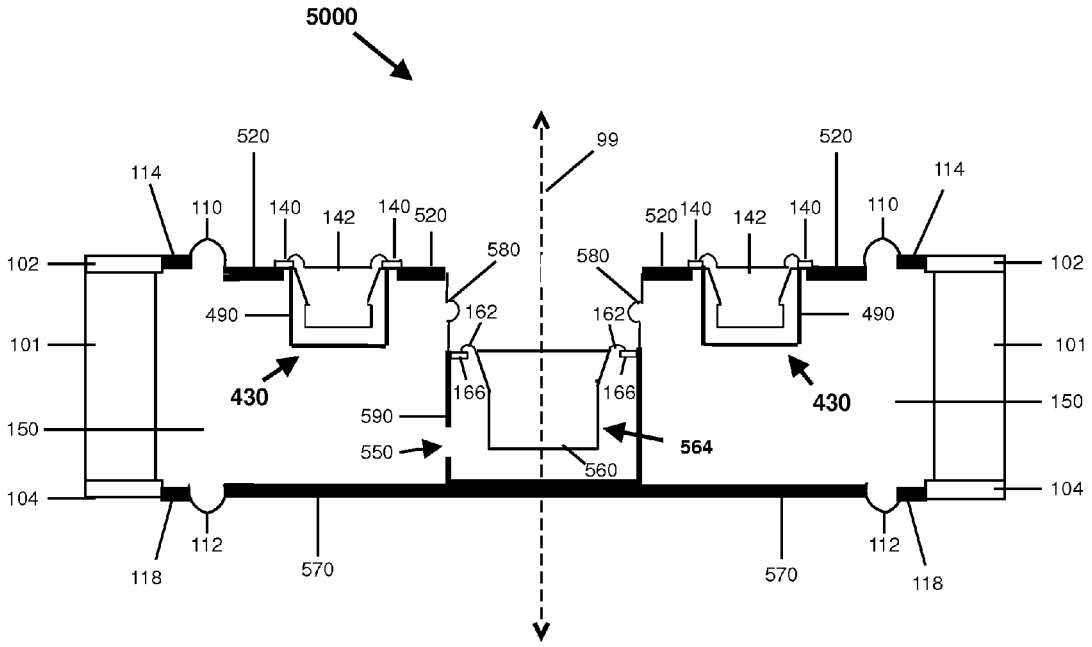
FIG. 5 is a cross-sectional view of another example of an acoustic device in which all the active drivers are facing in a common direction and one of the active driver assemblies is mounted directly to an inner surface of a passive radiator diaphragm.

FIG. 5 shows a cross-sectional view of another example of an acoustic device 5000 in which the acoustic driver assemblies 430 are secured to a passive radiator diaphragm 520 in a manner similar to that shown for the diaphragm 120 in FIG. 4; however, a woofer 560, or other acoustic driver, is configured to radiate from the same side of the enclosure as the active drivers 142. A significant amount of acoustic energy radiated by the woofer 560 may be at frequencies above the tuning frequency of the passive radiators, therefore the illustrated acoustic device 5000 has the advantage of radiating the acoustic energy at these higher frequencies in a common direction from a same side of the enclosure.

The passive radiator diaphragm 570 on the opposite side of the enclosure from the active drivers 142 does not have any holes or openings, and does not have an exposed acoustic driver. Instead, the woofer 560 is mounted in a frame 590 which is directly coupled to the inner surface of the passive radiator diaphragm 570. The woofer 560 and frame 590 are part of a woofer assembly 564. The frame 590 has openings 550 (only one shown in the figure) that allows acoustic radiation from the back side of the woofer 560 to pass into and pressurize the acoustic chamber 150. The frame 590 may be a rigid structure having a significant number of openings 550 or disposed around the frame perimeter or circumference so that acoustic energy is not significantly obstructed or attenuated. A compliant coupler 580, which may be similar to the compliant coupling elements described above for other acoustic devices, is used to couple the woofer assembly 564 to the passive radiator diaphragm 520.

A number of implementations have been described. Nevertheless, it will be understood that additional modifications may be made without departing from the scope of the inventive concepts described herein and, accordingly, other embodiments are within the scope of the following claims.

The invention claimed is:

1. An acoustic device comprising:

an acoustic enclosure having walls defining an acoustic chamber;

a first passive radiator diaphragm disposed in an opening of a first wall of the acoustic enclosure and configured to move parallel to a first axis that extends through a center of mass of the first passive radiator diaphragm and orthogonal to the first wall in response to a pressure change in the acoustic chamber;

a second passive radiator diaphragm disposed in an opening of a second wall of the acoustic enclosure and configured to move parallel to a second axis that extends through a center of mass of the second passive radiator diaphragm and orthogonal to the second wall in response to a pressure change within the acoustic chamber;

a first active driver assembly disposed in an opening in the first passive radiator diaphragm and protruding into the acoustic enclosure in a direction toward the second wall; and a plurality of second active drivers assemblies each disposed in an opening in the second passive radiator diaphragm and protruding into the acoustic enclosure in a direction toward the first wall, each of the second active driver assemblies being laterally offset from the second axis, wherein a sum of a distance by which the first active driver assembly protrudes into the acoustic enclosure and a distance by which one of the second active driver assemblies protrudes into the enclosure is greater than a separation of the first and second walls, wherein a first passive radiator assembly has a moving mass equal to a mass of the first passive radiator diaphragm and a mass of the first active driver assembly, and wherein a second passive radiator assembly has a moving mass equal to a mass of the second passive radiator diaphragm and a mass of each of the second active driver assemblies, and wherein the moving mass of the first passive radiator assembly is substantially equal to the moving mass of the second passive radiator assembly.

2. The acoustic device of claim 1, wherein, for each of the second active driver assemblies, a moment between a center of the second passive radiator diaphragm and a center of mass of the active driver assembly is substantially equal to a moment between the center of the second passive radiator diaphragm and each of the other active driver assemblies.

3. The acoustic device of claim 1, wherein a motion of the first passive radiator diaphragm and a motion of the second passive radiator diaphragm produce sound waves that are acoustically in phase and wherein a motion of the first passive radiator diaphragm and a motion of the second passive radiator diaphragm are mechanically out of phase.

4. The acoustic device of claim 1 wherein the first and second axes are parallel.

5. The acoustic device of claim 1 wherein the first and second axes are colinear.

6. The acoustic device of claim 1, further comprising a compliant coupling mechanism that couples the first active driver assembly to the second passive radiator diaphragm.

7. The acoustic device of claim 1, further comprising a compliant coupling mechanism that couples the first active driver assembly to at least one of the walls of the acoustic enclosure.

8. The acoustic device of claim 1, wherein each of the second active driver assemblies include a back enclosure to acoustically seal the active driver assembly from the acoustic chamber.

9. The acoustic device of claim 1 wherein the lateral offset of each of the second drive assemblies is equal to the lateral offset of each of the other second active driver assemblies.

10. The acoustic device of claim 1 wherein the first wall and the second wall are parallel to each other.

11. The acoustic device of claim 1 wherein the mass of the first active driver assembly is substantially equal to a sum of the masses of the second active driver assemblies.

12. An acoustic device comprising:

an acoustic enclosure having walls defining an acoustic chamber;

a first passive radiator diaphragm disposed in an opening of a first wall of the acoustic enclosure and configured to move parallel to a first axis that extends through a geometrical center of the first passive radiator diaphragm and orthogonal to the first wall in response to a pressure change in the acoustic chamber;

a second passive radiator diaphragm disposed in an opening of a second wall of the acoustic enclosure and configured to move parallel to a second axis that extends through a geometrical center of the second passive radiator diaphragm and orthogonal to the second wall in response to a pressure change within the acoustic chamber, the first and second walls of the acoustic enclosure being parallel to each other;

a first active driver assembly disposed in an opening in the first passive radiator diaphragm, protruding into the acoustic enclosure in a direction toward the second wall and having a geometrical center on the first axis; and a plurality of second active drivers assemblies each disposed in an opening in the second passive radiator diaphragm and protruding into the acoustic enclosure in a direction toward the first wall, each of the second active driver assemblies having a geometrical center that is laterally offset from the second axis, wherein a sum of a distance by which the first active driver assembly protrudes into the acoustic enclosure and a distance by which one of the second active driver assemblies protrudes into the enclosure is greater than a separation of the first and second walls, and wherein a sum of a moving mass of the first passive radiator diaphragm and a mass of the first active driver assembly is substantially equal to a sum of a moving mass of the second passive radiator diaphragm and a mass of each of the second active driver assemblies.

13. The acoustic device of claim 12 wherein the lateral offset of each of the second active driver assemblies is equal to the lateral offset of each of the other second active driver assemblies.

14. The acoustic device of claim 12, further comprising a compliant coupling mechanism that couples the first active driver assembly to the second passive radiator diaphragm.

15. The acoustic device of claim 12, further comprising a compliant coupling mechanism that couples the first active driver assembly to at least one of the walls of the acoustic enclosure.

16. The acoustic device of claim 12, wherein each of the second active driver assemblies include a back enclosure to acoustically seal the active driver assembly from the acoustic chamber.

17. An acoustic device comprising:

an acoustic enclosure having walls defining an acoustic chamber;

a first passive radiator diaphragm disposed in an opening of a first wall of the acoustic enclosure and configured to move parallel to a first axis that extends through a center of mass of the first passive radiator diaphragm and orthogonal to the first wall in response to a pressure change in the acoustic chamber;

a second passive radiator diaphragm disposed in an opening of a second wall of the acoustic enclosure and configured to move parallel to a second axis that extends through a center of mass of the second passive radiator diaphragm and orthogonal to the second wall in response to a pressure change within the acoustic chamber;

a first active driver assembly secured to a surface of the first passive radiator diaphragm and configured to radiate acoustic energy in a direction parallel to the first axis and through an opening in the second passive radiator diaphragm, the first active driver assembly protruding into the acoustic enclosure in a direction toward the second wall; and a plurality of second active drivers assemblies each disposed in an opening in the second passive radiator diaphragm and protruding into the acoustic enclosure in a direction toward the first wall, each of the second active driver assemblies being laterally offset from the second axis and configured to radiate acoustic energy in a direction substantially parallel to the first axis, wherein a sum of a distance by which the first active driver assembly protrudes into the acoustic enclosure and a distance by which one of the second active driver assemblies protrudes into the enclosure is greater than a separation of the first and second walls, and wherein a first passive radiator assembly has a moving mass equal to a mass of the first passive radiator diaphragm and a mass of the first active driver assembly, and wherein a second passive radiator assembly has a moving mass equal to a mass of the second passive radiator diaphragm and a mass of each of the second active driver assemblies, wherein the moving mass of the first passive radiator assembly is substantially equal to the moving mass of the second passive radiator assembly.

18. The acoustic device of claim 17, further comprising a compliant coupling mechanism that couples the first active driver assembly to the second passive radiator diaphragm at the opening in the second passive radiator diaphragm through which the acoustic energy from the first active driver assembly radiates.

19. The acoustic device of claim 17, wherein each of the second active driver assemblies includes a back enclosure to acoustically seal the active driver assembly from the acoustic chamber.

* * * * *